US006314727B1

(12) United States Patent
Prabhu et al.

(10) Patent No.: US 6,314,727 B1
(45) Date of Patent: Nov. 13, 2001

(54) METHOD AND APPARATUS FOR CONTROLLING AN ELECTRO-HYDRAULIC FLUID SYSTEM

(75) Inventors: Sameer M. Prabhu, Raleigh; Satyendra Singh, Cary; Brian F. Taggart, Angier, all of NC (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 09/426,706

(22) Filed: Oct. 25, 1999

(51) Int. Cl.[7] ..... F16D 31/02
(52) U.S. Cl. ..... 60/431; 74/68
(58) Field of Search ..... 60/431, 433, 434; 74/63, 68

(56) References Cited

U.S. PATENT DOCUMENTS

| | | | | |
|---|---|---|---|---|
| 3,890,360 | * | 6/1975 | Pruvot et al. | 60/431 |
| 4,534,707 | | 8/1985 | Mitchell | 60/431 X |
| 4,712,376 | | 12/1987 | Hadank et al. | 60/427 |
| 4,726,186 | * | 2/1988 | Tatsumi et al. | 60/434 |
| 4,738,104 | * | 4/1988 | Hahmann et al. | 60/431 |
| 4,809,504 | | 3/1989 | Izumi et al. | 60/430 |
| 4,884,402 | * | 12/1989 | Strenzke et al. | 60/426 |
| 5,077,973 | * | 1/1992 | Suzuki et al. | 60/428 |
| 5,111,789 | * | 5/1992 | Moriya et al. | 123/357 |
| 5,117,632 | * | 6/1992 | Strenzke | 60/431 X |
| 5,214,916 | | 6/1993 | Lukich | 60/431 |
| 5,267,441 | | 12/1993 | Devier et al. | 60/452 |
| 5,295,353 | * | 3/1994 | Ikari | 60/431 |
| 5,525,043 | * | 6/1996 | Lukich | 60/431 X |
| 5,622,050 | * | 4/1997 | Ishino et al. | 60/431 |
| 5,638,677 | * | 6/1997 | Hosono et al. | 60/431 |
| 5,930,996 | * | 8/1999 | Nakamura et al. | 60/426 |

* cited by examiner

*Primary Examiner*—John E. Ryznic
(74) *Attorney, Agent, or Firm*—W. Bryan McPherson, III

(57) ABSTRACT

The present invention provides a method and apparatus for controlling a electro-hydraulic system of an earthmoving machine. The electro-hydraulic system may include a pump providing fluid to at least one fluid system. The electro-hydraulic system also includes an engine connected to the pump, and a controller for providing a commands to the engine. The method includes the steps of determining a desired characteristic of the fluid system, comparing the desired characteristic with a deliverable characteristic of the fluid system, and generating a power boost in response to the comparison; thereby controlling the electro-hydraulic system.

43 Claims, 2 Drawing Sheets

METHOD AND APPARATUS FOR CONTROLLING AN ELECTRO-HYDRAULIC FLUID SYSTEM

TECHNICAL FIELD

This invention relates generally to an electro-hydraulic fluid system, and more particularly, to a method and apparatus for controlling an electro-hydraulic fluid system.

BACKGROUND ART

Earth moving machines such as a wheel loader, may include an elector-hydraulic system having several fluid systems, such as the transmission, implement, and steering fluid systems. The engine, and associated pump(s), of the earth moving machine deliver the desired power, or desired fluid flow to these systems in order to provide the desired system responsiveness to the operator. However, there are times during operation of the vehicle, when the needs of the various fluid systems exceed what the engine may provide. For example, when the load of the hydraulic system exceeds the capability of the pump and engine, the engine may begin to lug. When the engine is unable to provide the desired power to the fluid systems, i.e., the electro-hydraulic system is saturated, the responsiveness of the electro-hydraulic system is undesirably reduced. Using algorithms to prioritize how the available power is distributed among the fluid systems helps allocate the available power, however the electro-hydraulic system is still unable to deliver the desired responsiveness to the operator for the fluid systems.

The present invention is directed to overcoming one or more of the problems identified above.

DISCLOSURE OF THE INVENTION

In one aspect of the present invention, a method for controlling an electro-hydraulic fluid system of an earth-moving machine is provided. The electro-hydraulic fluid system includes a pump providing fluid to at least one fluid system, an engine connected to the pump, the engine providing power to the pump, and a controller for providing a command to the engine. The method includes the steps of determining a desired characteristic of the fluid system, comparing the desired characteristic with a deliverable characteristic, and generating a power boost in response to said desired characteristic and said deliverable characteristic.

In another aspect of the present invention, an apparatus adapted to control an electro-hydraulic system of an earth-moving machine, the electro-hydraulic system including a pump providing fluid to at least one fluid system, an engine connected to the pump, the engine providing power to the pump, and a controller for providing a command to the engine. The apparatus comprises a pump adapted to provide fluid to at least one of the fluid systems, an engine mechanically connected to the pump, and a controller adapted to determining a desired characteristic of the electro-hydraulic system, comparing said desired characteristic with a deliverable characteristic of the electro-hydraulic system, and generating a power boost in response to the comparison; thereby controlling the electro-hydraulic system.

BEST MODE FOR CARRYING OUT THE INVENTION

Figure 1:
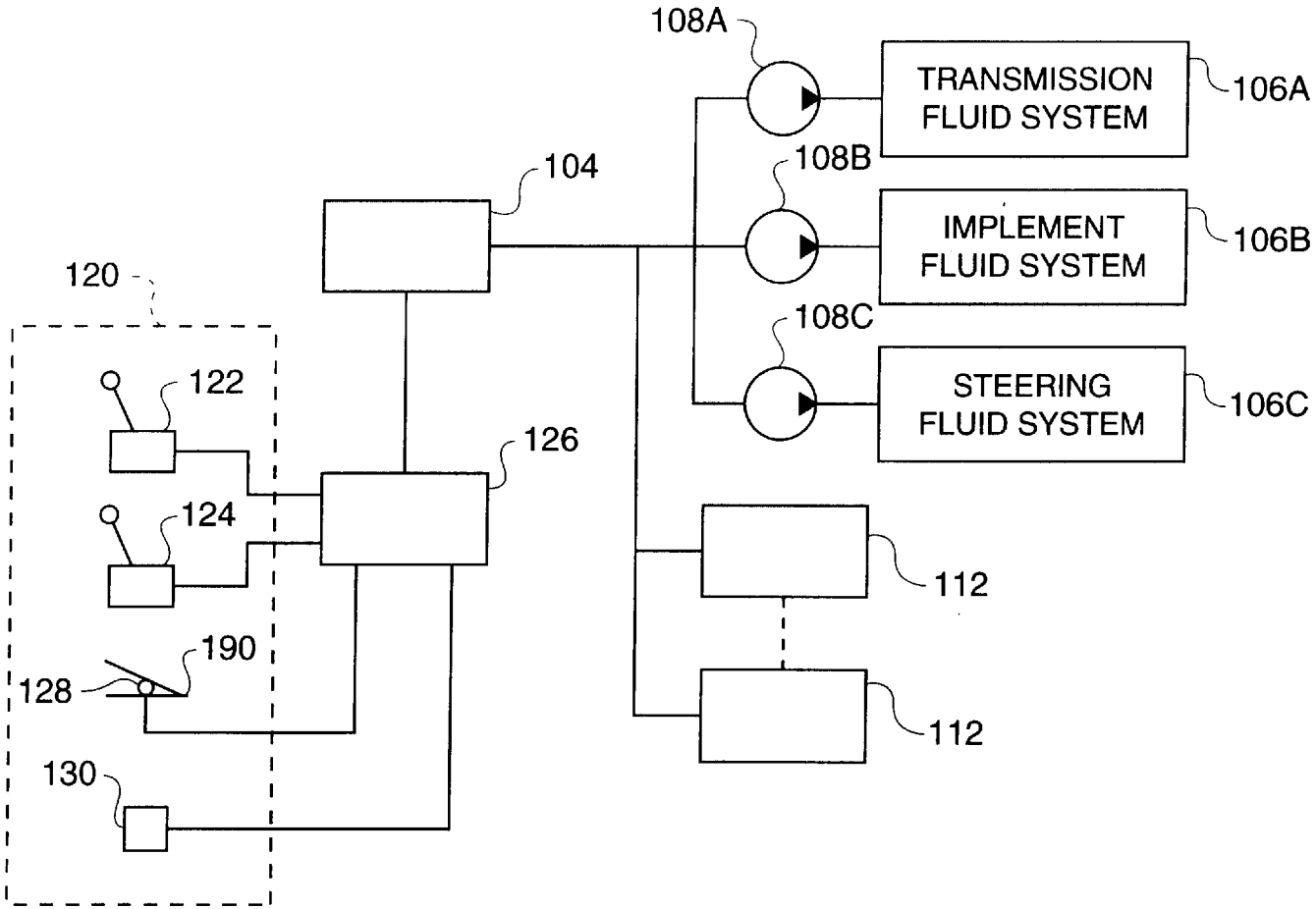
FIG. 1 is a high level diagram of an electro-hydraulic system.

The present invention provides an apparatus and method for controlling an electro-hydraulic system of an earth moving machine. FIG. 1 illustrates one embodiment of an electro-hydraulic system 102 associated with the present invention. The electro-hydraulic system 102 includes an engine 104 and at least one fluid system 106. The electro-hydraulic system 102 may include a transmission fluid system 106A, an implement fluid system 106B, and a steering fluid system 106C. FIG. 1 also illustrates each fluid system 106 including a pump 108. The pump 108 may be either a fixed displacement pump or a variable displacement pump. Alternatively, one pump 108, may deliver fluid to multiple fluid systems 106.

As illustrated in FIG. 1, the engine 104 may drive one or more pumps 108. In one embodiment, the engine 104 may be mechanically connected to one or more parasitic loads 112. Examples of a parasitic load 112 may include, a cooling fan, condenser fan, a/c compressor, heater, water pump, general electrical loads, and lights.

In the preferred embodiment, the electro-hydraulic system 102 includes an input controller 120. An input controller 120, may include at least one control lever mechanism. FIG. 1 illustrates a first and second control lever mechanisms 122, 124, e.g., joysticks, that are each connected to an electrical controller 126. The control lever mechanisms 122, 124 output an electrical signal to the controller 126 proportional to an input from an operator. In addition, the input controller 120 may include an speed pedal sensor 128, or throttle sensor, associated with a speed pedal 190, or throttle. The speed pedal sensor 128 may output an electrical signal to the controller 126 indicative of the operators desired speed. In addition, the input controller 120 may include a steering wheel sensor 130. The steering wheel sensor 130 may output an electrical signal to the controller 126 indicative of the operators desired steering commands.

Alternatively, the machine may be autonomously controlled by a software program that generates the appropriate input control commands, such as a desired speed signal, a desired implement control signal, and/or a desired steering control signal. The software program may execute on the controller 126. In addition, the electro-hydraulic system 102 may have multiple controllers 126 to control the engine, transmission, and hydraulics fluid systems 106.

In one embodiment, the controller 126 determines a desired characteristic of the electro-hydraulic system 102, compares the desired characteristic with a deliverable characteristic of the system 102, and generates a power boost in response to the comparison of the desired characteristic and the deliverable characteristic.

The electro-hydraulic system 102 may include a transmission output torque sensor (not shown) adapted to sense the output torque of the transmission and responsively deliver a torque signal to the controller 126. Alternatively the output torque of the transmission may be estimated from the fluid pressure and clutch state. The system 102 may include a pressure sensor adapted to sense the pressure of the fluid in the fluid system and responsively deliver a pressure signal to the controller 126.

Figure 2:
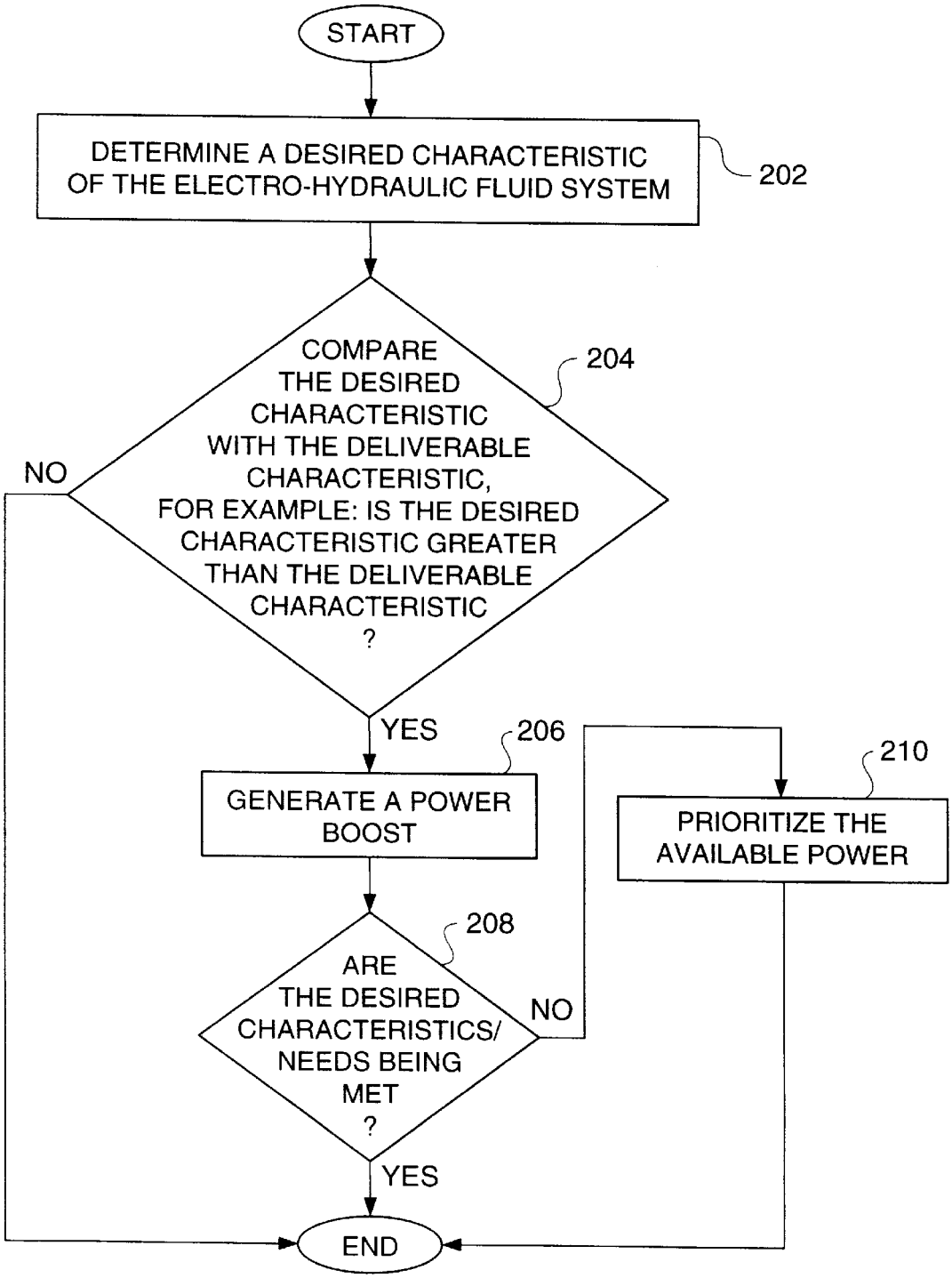
FIG. 2 is a high level flow diagram illustrating a method for controlling an electro-hydraulic fluid system of an earth-moving machine.

FIG. 2 illustrates one embodiment of a method of controlling an electro-hydraulic system 102. The method includes the steps of determining a desired characteristic of the electro-hydraulic system 102, comparing the desired characteristic with a deliverable characteristic of the electro-hydraulic system 102, generating a power boost in response to the comparison of the desired characteristic and the deliverable characteristic; thereby controlling the electro-hydraulic system 102. In a first control block 202, a desired characteristic of the electro-hydraulic system 102 is determined. In the preferred embodiment, the desired characteristic determined is the power desired to be generated by the engine 104. In one embodiment, the desired power may be determined by computing and combining the power desired by each fluid system 106.

In one embodiment, the desired power of the transmission fluid system 106A may be determined in response to the desired transmission speed and the transmission output torque. For example:

Desired power=(desired transmission speed*transmission torque)

The position of the speed pedal 190 is indicative of the desired transmission speed. In one embodiment, the pedal position may be converted to an angular speed of the transmission shaft based upon a nominal radius of the tires on the machine. In one embodiment, the torque sensor may be used to sense a transmission output torque indicative of the load of the transmission fluid system 106A. The desire power may then be determined based on the transmission speed, and the transmission torque.

In an alternative embodiment, the desired power for the transmission system 106A may be determined in response to the load and desired fluid flow. For example:

Desired Power=Fluid Pressure*Desired Flow

The desired machine speed may be mapped into a desired rotary speed, and corresponding pump displacement. The desired fluid flow may be determined from the desired rotary speed and pump displacement. The desired flow times the fluid pressure may then result in a desired transmission power.

The desired power for the implement and steering fluid systems 106A, 106B may be computed based on the desired fluid flow of each system 10GB, 106C. For example, in the preferred embodiment:

Desired Power=(Load*Desired Flow)/Efficiency

The current load associated with each fluid system 106B, 106C and the desired fluid flow associated with each fluid system 106, may be determined.

For example, in one embodiment, the pressure sensor may be used to sense the implement pump pressure indicative of a load of the implement fluid system 106B, and a steering pump pressure indicative of the load of a steering fluid system 106C. In one embodiment, the respective loads of the implement fluid system 106B, and the steering fluid system 106C, are the implement pump pressure, and the steering pump pressure respectively.

In one embodiment, the desired fluid flow may be determined by operator inputs. The control lever mechanisms 122, 124, e.g., implement lift and tilt levers, may be indicative of desired implement control inputs which are, in turn, indicative of the fluid flow desired of the implement fluid system 106. For example, lever movements correspond to a desired velocity of the implements. Depending on the direction of movement of the lever, fluid flow will be directed to either the head or rod end of the cylinder (not shown). Therefore, the desired velocity times the head (or rod) end area, yields the desired fluid flow. An input representative of the steering wheel position is indicative of fluid flow desired by the steering fluid system 106B. Alternatively, an autonomous implement control program running on the controller 104, may generate desired fluid flow values.

In the preferred embodiment, the efficiency of each fluid system 106 may be determined as a function of system variables such as the load, speed, and flow. These functions may be in the form of equations or maps that have been empirically determined. Alternatively, component suppliers may provide efficiency maps which may be used determine the efficiency of the pump, or engine. For example, the pump efficiency may be dynamically determined by measuring the pump pressure. The pump efficiency may then be determined in response to the pump pressure and the efficiency maps. Alternatively, predetermined pump efficiency value may be utilized in response to an average system efficiency. The average efficiency may be calculated by averaging the efficiency values at discrete points in the operating range. A weighted average which takes into account the time usually spent at the discrete operating points may also be used. The weighted, or average efficiency value may be used as the average efficiency. The desired power of the implement fluid system 106B and the steering fluid system 106C may be determined in response to the load, desired fluid flow, and efficiency of the respective fluid systems 106 B,C. Therefore, the power for each fluid system 106 may be determined and combined to determine a total desired power for the electro-hydraulic system 102.

In one embodiment, the desired power of each fluid system 106 may be limited to a maximum power that each system 106 may physically be able to absorb. For example, the maximum load may be fixed by the relief pressure of the system, and the maximum flow may be limited by the maximum pump displacement and the rated, or the high idle engine speed. In the case of the implement, steering and transmission fluid systems 106 A,B,C, the pump relief pressure, i.e., the setting of the relief pressure of a relief valve (not shown), may be multiplied by a maximum pump flow capacity to determine the maximum power that may be absorbed (e.g., max power=relief pressure settings*max pump flow capacity). The maximum pump flow capacity may be determined by multiplying the maximum pump displacement times the rated engine speed. In one embodiment, the rated engine speed is provided by the supplier. The rated engine speed may be stated as being rated at a particular horsepower at a particular revolutions per minute. Alternatively, in the case of the transmission fluid system 106A, the continuous duty power rating of the engine 104 may be used as the maximum power for the transmission system 106A.

In a first decision block 204, the desired characteristic is compared to a deliverable characteristic of the electro-hydraulic system 102. The desired characteristic may be compared to the deliverable characteristic in order to determine if the current power needs of the fluid systems 106 are being met. In one embodiment, if the deliverable characteristic is greater than or equal to the desired characteristic, then the need of the fluid systems 106 are being met. In the preferred embodiment, the deliverable characteristic is a characteristic indicative of the fluid systems 106 ability to deliver the desired amount of fluid to the systems 106. In the preferred embodiment, the deliverable characteristic is the continuous duty power rating of the engine 104. However, other examples of the deliverable characteristic include, pump displacement, maximum pump flow, and engine speed. Therefore, for example, if the total desired power is less than or equal to the continuous duty power rating, then the needs of the system 102 are being met. That is, each fluid system 106 will receive the desired fluid flow in order to provide the desired responsiveness. However, if the desired characteristic, e.g., total desired power, is greater than the deliverable characteristic, e.g., continuous duty power rating, then control passes to a second control block 206 to generate a power boost.

In one embodiment, a power boost may be described as a boost that enables increased energy to be delivered to the pump(s) 108 resulting in increased fluid flow. The increased fluid flow will enable the fluid systems 106 to meet the desired power requirements. In the preferred embodiment, the techniques available for providing a power boost include disconnecting, or disabling, one or more of the parasitic loads 112 from the engine 104, and/or delivering a power boost command to the engine 104 that will enable the engine to increase the continuous duty power rating.

In one embodiment, if a power boost is desired, the parasitic loads 112 are disconnected. Parasitic loads 112 may be connected to the engine 104. For example, some parasitic loads 112, such as fans, may be belt driven by the engine 104, i.e., the loads 112 may be connected to the flywheel (not shown) of the engine 104. When the fan 112 is running it absorbs more power from the engine 104, via the belt resistance (friction) than if the fan was not running. When these loads 112 are turned off, the engine 104 is able to provide more power, or energy, to the fluid systems 106 via the engine flywheel, which connects the engine 104 to the pump 108. That is the available engine torque may increase when the parasitic loads 112 are turned off, enabling an increased pump displacement. Therefore, when a power boost is desired, a determination is made as to whether parasitic loads 112 are currently connected, or enabled, e.g., that a fan is running, or not running. The parasitic loads 112 are electrically driven, and may be turned on and off, accordingly. If there are enabled loads 112, then, in one embodiment, the controller 106 is able to send a command signal to the load 112, turning the load 112 off, i.e., disconnecting, or disabling the load 112. When the load 112 is disconnected, the engine 104 is able to provide additional power, or a power boost, to the fluid systems 106.

In an alternative embodiment, in order to provide the power boost, the engine 104 may be commanded to temporarily produce more than the continuous duty power rating. For example, a power boost command may be delivered to the engine 104 to increase the power boost level by 10–20% over the continuous duty rating of the engine 104. In the preferred embodiment, before a power boost command is delivered to the engine 104, a diagnostic check is performed to determine whether the machine is performing in a desired manner, e.g., not overheating. For example, several fluid temperatures may be monitored to determine the status of the engine 104. If the fluid condition(s) are within a desired range indicating the engine status is okay, then the power boost command may be delivered to the engine 104. In the preferred embodiment, the fluids to be monitored include the engine coolant temperature, the hydraulic oil temperature, and the transmission oil temperature. If the monitored fluid(s) are within an acceptable range, e.g., not exceeding a temperature threshold, then the power boost may be enabled. Alternatively, the rate of change of the temperature of the fluid(s) may be monitored to predict the fluid temperatures, providing a quicker indication of whether the engine 104 is overheating, or beginning to overheat. Therefore, if the fluid temperatures, and/or the rate of change of the temperatures is outside a desired range, then a determination is made not to enable the power boost.

In one embodiment, once the power boost has been enabled by either disabling one or more of the parasitic loads 112, or delivering a power boost command to the engine 104, the deliverable characteristic, e.g., deliverable engine power, is redetermined. If the deliverable characteristic, e.g., continuous duty power rating, is still less than the desired characteristic, e.g., desired power, then another power boost technique may be implemented. For example, if the parasitic loads were disabled, and the desired engine power was not obtained, then a power boost command may also be delivered to the engine 104 to attempt to provide the desired engine power.

In one embodiment, if the power boost command is delivered to the engine 104, the fluid temperatures may continue to be monitored. If the fluid temperatures exceed the desired temperature threshold, or the fluid temperatures or rate change become outside the desired ranges, the power boost command may be disabled. The power boost command may be disabled when the fluid temperatures exceed a threshold by ramping down the command gradually to 0, returning to the normal operating continuous duty rating of the engine 104. The time duration of the ramp up/down of engine power boost level may depend on the design characteristics of the engine 104, such as the allowable engine overload, machine application requirements/needs, and desired operator responsiveness. Ramping down the power boost, when the temperatures exceed the threshold, enables variations to machine responsiveness to be small, as compared to stopping the power boost all at once.

In an alternative embodiment, the power boost may be disabled when a time-averaged engine power level exceeds a desired power threshold. A time-averaged engine power level may be determined in response to an engine torque and speed. For example, power is based on torque times speed. In one embodiment, the engine torque may be estimated based on the quantity of fuel injected. The engine speed may be sensed using a speed sensor. The power may then be averaged over time, where:

$$\text{Power} = \frac{\sum Pi\Delta T}{\sum \Delta T}$$

where $\Delta T$=sampling time of the controller

Pi=power computed as above at each of the sampling intervals

If the time-averaged engine power level exceeds certain design limits, then the engine power boost command may be disabled.

In addition, in one embodiment, the power boost command may be disabled after a determined time period. The time period may predetermined, or dynamically determined based on the magnitude of the command.

After commanding the power boost, in a second decision block 208, the deliverable characteristic, e.g., the deliverable power, is recalculated to see if the desired characteristic, e.g., desired power, needs of the fluid systems 106 are being met. If the desired power still exceeds the deliverable power, and no other power boost technique is available or desired, then, in third control block 210, a priority scheme may be implemented. There are many different priority schemes that may be implemented. For example, in one embodiment, the steering fluid system's 106C power demands are always met, if possible. Therefore, the steering systems power 106C demands may be subtracted from the total available power, and the remaining power may be distributed between the implement fluid system 106B and the transmission fluid system 106A. Power may be distributed to the fluid systems 106A,B,C by varying the displacement of the pumps, or varying the positions of the valves (not shown) in the fluid systems 106. The power distribution may be based on the applications the machine is currently performing. Therefore, the power distribution may be dynamically changed based on the current application. In addition, the power may be controlled by an operator input. That is, the operator may be able to provide an input that will control the allocation of power among the fluid systems in order to meet the operators current needs.

In one embodiment, if one or more power boost techniques have been enabled, the desired and deliverable characteristics continue to be monitored. When the desired characteristic is less than the deliverable characteristic, then the power boost command may be disabled, enabling the engine 104 to rapidly return to the continuous duty rating delivered under normal operating conditions. The rapid return to the continuous duty rating may be used because the additional power is no longer needed, therefore the operator will not notice the drop in power that occurs when the power boost is disabled.

In one embodiment, the desired engine power must drop below the deliverable engine power by an established margin before the power boost is disabled. The margin helps to prevent toggling between enabling and disabling the power boost command. The margin may be a dynamically determined value, or a predetermined value.

INDUSTRIAL APPLICABILITY

The present invention provides a method and apparatus for controlling a electro-hydraulic system of an earthmoving machine. The electro-hydraulic system may include a pump providing fluid to at least one fluid system. The electro-hydraulic system also includes an engine connected to the pump, and a controller for providing commands to the engine. The method includes the steps of determining a desired characteristic of the fluid system, comparing the desired characteristic with a deliverable characteristic of the fluid system, and generating a power boost in response to the comparison of the desired characteristic and the deliverable characteristic; thereby controlling the electro-hydraulic system.

In one embodiment, a total desired power (the desired characteristic), is compared to a continuous duty power rating of the engine (the deliverable characteristic). If, based on this comparison, the engine is unable to currently provide the desired power to the fluid systems, then the electro-hydraulic system 102 attempts to provide a power boost. Techniques for providing a power boost include: disabling, e.g., turning off, parasitic loads that may be running, and/or delivering a power boost command to the engine. Delivering a power boost command to the engine, may increase the power of the engine 104 by 10–20% of the continuous duty power rating. Once the power boost is generated, if the desired power is still not being satisfied, a priority scheme may be implemented to prioritize and determine the power each fluid system will receive.

In one embodiment, if a power boost technique is enabled, once the desired power drops below the available power by an established margin, the power boost technique(s) may be discontinued. That is, if parasitic loads were turned off, they may be turned back on, and if a power boost command was delivered to the engine 104, the command may be discontinued.

Other aspects, objects and advantages of the present invention can be obtained from a study of the drawings, the disclosure and the appended claims.

What is claimed is:

1. A method of controlling an electro-hydraulic system of an earthmoving machine, the electro-hydraulic fluid system including a pump providing fluid to at least one fluid system, an engine connected to the pump, the engine providing power to the pump, at least one parasitic load connected to said engine, and a controller configured to provide a command to the engine, comprising the steps of:

determining a desired characteristic of said fluid system;

comparing said desired characteristic with a deliverable characteristic of said fluid system; and generating a power boost in response to said desired characteristic being greater than said deliverable characteristic and one of delivering a power boost command to said engine and disabling at least one of said at least one parasitic load from said engine; thereby increasing said deliverable characteristic in response to said power boost and controlling the fluid system.

2. A method, as set forth in claim 1, wherein the step of determining said desired characteristic further includes the step of determining a desired power of said engine.

3. A method, as set forth in claim 2, wherein the step of determining said desired engine power further includes the steps of:

determining a desired fluid flow of said fluid system; and, determining said desired engine power in response to said desired fluid flow.

4. A method, as set forth in claim 3, wherein the step of determining a desired engine power further includes the steps of:

determining an actual load of said fluid system; and, determining said desired engine power in response to said desired fluid flow and said actual system load.

5. A method, as set forth in claim 4, wherein the step of determining a desired engine power further includes the steps of:

determining an efficiency of said fluid system; and, determining said desired engine power in response to said desired fluid flow, said actual system load and said system efficiency.

6. A method, as set forth in claim 5, wherein the step of determining a deliverable characteristic of said fluid system further includes the step of determining an actual power rating of said engine.

7. A method, as set forth in claim 6, wherein the step of comparing said desired characteristic and said deliverable characteristic further includes the step of comparing said desired engine power and said actual engine power rating.

8. A method, as set forth in claim 1, wherein the step of determining said desired characteristic further includes the step of determining a desired fluid flow of said pump.

9. A method, as set forth in claim 8, wherein the step of determining said desired fluid flow further includes the steps of:

determining an actual load of said fluid system; and, determining said desired fluid flow in response to said actual system load.

10. A method, as set forth in claim 9, wherein the step of determining said desired characteristic further includes the steps of:

determining an efficiency of said fluid system; and, determining a desired engine power in response to said desired fluid flow, said actual system load and said system efficiency.

11. A method, as set forth in claim 10, wherein the step of determining a deliverable characteristic of said fluid system further includes the step of establishing an actual power rating of said engine.

12. A method, as set forth in claim 8, wherein the step of determining a deliverable characteristic of said fluid system further includes the step of determining a fluid flow limit of said pump.

13. A method, as set forth in claim 12, wherein the step of comparing said desired characteristic and said deliverable characteristic further includes the step of comparing said desired fluid flow and said first fluid flow limit.

14. A method, as set forth in claim 13, wherein the step of generating a power boost includes the step of generating said power boost response to said desired fluid being greater than said first fluid flow limit.

15. A method, as set forth in claim 14, further including the step of increasing said fluid flow limit in response to said power boost.

16. A method, as set forth in claim 1, wherein the step of delivering a power boost command further includes the steps of:

determining at least one fluid condition; and, delivering said power boost in response to said fluid condition being within an predetermined range.

17. A method, as set forth in claim 16, further including the steps of:

monitoring at least one fluid condition;

gradually reducing said power boost command in response to said fluid condition being outside a redetermined range.

18. A method, as set forth in claim 1, further comprises the steps of:

determining a second deliverable characteristic in response to said power boost;

determining a second desired characteristic; and prioritizing a distribution of power to said at least one fluid system when said second deliverable characteristic is less than said desired characteristic.

19. A method, as set forth in claim 18, further comprises the steps of:

determining a second deliverable characteristic in response to said power boost;

determining a second desired characteristic; and discontinuing said power boost when said second desired characteristic is less than said deliverable characteristic.

20. A method, as set forth in claim 1, wherein the step of determining a deliverable characteristic of said fluid system further includes the step of determining an actual power rating of said engine.

21. A method, as set forth in claim 1, wherein the step of generating said power boost further includes the step of generating said power boost in response to one of delivering a power boost command to said engine and disabling a parasitic load from said engine.

22. An apparatus adapted to control an electro-hydraulic system of an earthmoving machine, the electro-hydraulic system including a pump providing fluid to at least one fluid system, an engine connected to the pump, the engine providing power to the pump, and a controller for providing a command to the engine, comprising:

a pump adapted to provide fluid to at least one of the fluid systems;

an engine mechanically connected to said pump;

a sensor adapted to sense a parameter indicative of desired characteristic of the electro-hydraulic system, and responsively generate a sensed signal;

at least one parasitic load connected to said engine; and a controller adapted to receive said sensed signal, determine a desired characteristic of said electro-hydraulic system in response to said sensed signal, compare said desired characteristic with a deliverable characteristic of said electro-hydraulic system, and generate a power boost in response to said desired characteristic being greater than said deliverable characteristic by one of delivering a power boost command to said engine and disabling at least one of said at least one parasitic load from said engine; thereby controlling the electro-hydraulic system.

23. An apparatus, as set forth in claim 22, wherein the controller is further adapted to determining a desired power of said engine in response to said sensed signal.

24. An apparatus, as set forth in claim 23, wherein the controller is further adapted to determine a desired fluid flow of said electro-hydraulic system; and, determine said desired engine power in response to said desired fluid flow.

25. An apparatus, as set forth in claim 24, wherein the controller is further adapted to determine an actual load of said electro-hydraulic system, and determine said desired engine power in response to said desired fluid flow and said actual system load.

26. An apparatus, as set forth in claim 25, wherein the controller is further adapted to determine an efficiency of said electro-hydraulic system; and, determine said desired engine power in response to said desired fluid flow, said actual system load and said system efficiency.

27. An apparatus, as set forth in claim 26, wherein the controller is further adapted to determine an actual power rating of said engine.

28. An apparatus, as set forth in claim 27, wherein the controller is further adapted to compare said desired engine power and said actual engine power rating.

29. An apparatus, as set forth in claim 22, wherein the controller is further adapted to determine a desired fluid flow of said pump.

30. A method of controlling an electro-hydraulic system of an machine, the electro-hydraulic fluid system including a pump providing fluid to at least one fluid system, an engine connected to the pump, the engine providing power to the pump, at least one parasitic load connected to said engine, and a controller configured to provide a command to the engine, comprising the steps of:

determining a desired characteristic of said fluid system;

comparing said desired characteristic with a deliverable characteristic of said fluid system; and generating a power boost in response to said comparison, wherein said power boost is provided by disabling at least one of said at least one parasitic load from said engine; thereby controlling the fluid system.

31. A method, as set forth in claim 30, wherein the step of generating a power boost further includes the step of generating a power boost in response to said desired characteristic being greater than said deliverable characteristic.

32. A method, as set forth in claim 31, further including the step of increasing said deliverable characteristic in response to said power boost.

33. A method, as set forth in claim 32, wherein the step of determining said desired characteristic further includes the step of determining a desired power of said engine.

34. A method, as set forth in claim 33, wherein the step of determining said desired engine power further includes the steps of:

determining a desired fluid flow of said fluid system; and, determining said desired engine power in response to said desired fluid flow.

35. A method, as set forth in claim 34, wherein the step of determining a desired engine power further includes the steps of:

determining an actual load of said fluid system; and, determining said desired engine power in response to said desired fluid flow and said actual system load.

36. A method, as set forth in claim 35, wherein the step of determining a desired engine power further includes the steps of:

determining an efficiency of said fluid system; and, determining said desired engine power in response to said desired fluid flow, said actual system load and said system efficiency.

37. A method, as set forth in claim 36, wherein the step of determining a deliverable characteristic of said fluid system further includes the step of determining an actual power rating of said engine.

38. A method, as set forth in claim 37, wherein the step of comparing said desired characteristic and said deliverable characteristic further includes the step of comparing said desired engine power and said actual engine power rating.

39. A method, as set forth in claim 32, wherein the step of determining said desired characteristic further includes the step of determining a desired fluid flow of said pump.

40. A method, as set forth in claim 39, wherein the step of determining said desired fluid flow further includes the steps of:

determining an actual load of said fluid system; and, determining said desired fluid flow in response to said actual system load.

41. A method, as set forth in claim 32, wherein the step of delivering a power boost command further includes the steps of:

determining at least one fluid condition; and, generating said power boost in response to said fluid condition being within an predetermined range.

42. A method, as set forth in claim 32, further comprises the steps of:

determining a second deliverable characteristic in response to said power boost;

determining a second desired characteristic; and prioritizing a distribution of power to said at least one fluid system when said second deliverable characteristic is less than said desired characteristic.

43. An apparatus adapted to control an electro-hydraulic system of an earthmoving machine, the electro-hydraulic system including a pump providing fluid to at least one fluid system, an engine connected to the pump, the engine providing power to the pump, and a controller for providing a command to the engine, comprising:

a pump adapted to provide fluid to at least one of the fluid systems;

an engine mechanically connected to said pump;

at least one of an input controller and a sensor adapted to sense a parameter indicative of desired characteristic of the electro-hydraulic system, and responsively generate a sensed signal;

at least one parasitic load connected to said engine; and a controller adapted to receive said sensed signal, determine a desired characteristic of said electro-hydraulic system in response to said sensed signal, compare said desired characteristic with a deliverable characteristic of said electro-hydraulic system, and generate a power boost in response to said desired characteristic being greater than said deliverable characteristic by one of delivering a power boost command to said engine and disabling at least one of said at least one parasitic load from said engine.

* * * * *